US011268177B2

(12) United States Patent
Adachi et al.

(10) Patent No.: US 11,268,177 B2
(45) Date of Patent: Mar. 8, 2022

(54) AUSTENITIC STAINLESS STEEL

(71) Applicant: NIPPON STEEL & SUMITOMO METAL CORPORATION, Tokyo (JP)

(72) Inventors: Kazuhiko Adachi, Tokyo (JP); Akihiro Nishimura, Tokyo (JP); Shinichi Teraoka, Tokyo (JP); Hideki Fujii, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 498 days.

(21) Appl. No.: 15/763,164

(22) PCT Filed: Sep. 27, 2016

(86) PCT No.: PCT/JP2016/078472
§ 371 (c)(1),
(2) Date: Mar. 26, 2018

(87) PCT Pub. No.: WO2017/057369
PCT Pub. Date: Apr. 6, 2017

(65) Prior Publication Data

US 2018/0265954 A1 Sep. 20, 2018

(30) Foreign Application Priority Data

Sep. 30, 2015 (JP) ..... JP2015-195176

(51) Int. Cl.

| | |
|---|---|
| ***C22C 38/50*** | (2006.01) |
| ***C22C 38/00*** | (2006.01) |
| ***C23C 8/26*** | (2006.01) |
| ***C23C 8/02*** | (2006.01) |
| ***C22C 38/58*** | (2006.01) |
| ***C22C 38/40*** | (2006.01) |
| ***C21D 6/00*** | (2006.01) |
| ***C21D 9/56*** | (2006.01) |
| ***C22C 38/02*** | (2006.01) |
| ***C22C 38/04*** | (2006.01) |
| ***C22C 38/46*** | (2006.01) |
| ***C22C 38/48*** | (2006.01) |
| *C21D 1/76* | (2006.01) |
| *C21D 8/02* | (2006.01) |

(52) U.S. Cl.

CPC ..... *C22C 38/50* (2013.01); *C21D 6/004* (2013.01); *C21D 9/561* (2013.01); *C22C 38/00* (2013.01); *C22C 38/001* (2013.01); *C22C 38/02* (2013.01); *C22C 38/04* (2013.01); *C22C 38/40* (2013.01); *C22C 38/46* (2013.01); *C22C 38/48* (2013.01); *C22C 38/58* (2013.01); *C23C 8/02* (2013.01); *C23C 8/26* (2013.01); *C21D 1/76* (2013.01); *C21D 8/0278* (2013.01); *C21D 2211/001* (2013.01)

(58) Field of Classification Search

CPC ..... C22C 38/50
USPC ..... 420/48
See application file for complete search history.

(56) References Cited

U.S. PATENT DOCUMENTS

| | | | | |
|---|---|---|---|---|
| 2012/0237388 | A1* | 9/2012 | Sawada | C22C 38/02 420/49 |
| 2014/0150734 | A1* | 6/2014 | Nishiyama et al. | F22B 37/10 122/235.12 |

FOREIGN PATENT DOCUMENTS

| | | | |
|---|---|---|---|
| CN | 1833043 | | 9/2006 |
| CN | 103215536 | | 7/2013 |
| EP | 1 302 556 | | 4/2003 |
| JP | 2003-113449 | | 4/2003 |
| JP | 2006-070313 | | 3/2006 |
| JP | 2007-031777 | | 2/2007 |
| JP | 2007-126688 | | 5/2007 |
| JP | 2007-270350 | | 10/2007 |
| JP | 2009-001863 | | 1/2009 |
| JP | 2009-133001 | | 6/2009 |
| JP | 2009-299174 | | 12/2009 |
| JP | 2014-109059 | | 6/2014 |
| JP | 2014-114471 | | 6/2014 |
| JP | 5744678 | B2 * | 7/2015 |
| WO | WO-3095693 | A1 * | 11/2003 |
| WO | 2007/052773 | | 5/2007 |
| WO | 2015/087376 | | 6/2015 |

OTHER PUBLICATIONS

JP 2014-1422A, Sawada, Austenitic Stainless Steel Plate and Manufacturing Method for the Same, Jan. 2014 (Year: 2014).*
Translation JP-5744678-B2 (Year: 2015).*
Translation WO-3095693-A1 (Year: 2003).*
(Continued)

*Primary Examiner* — Sally A Merkling
*Assistant Examiner* — Danielle Carda
(74) *Attorney, Agent, or Firm* — Clark & Brody LP

(57) ABSTRACT

An austenitic stainless steel according to the present invention has a chemical composition containing, by mass %: C: 0.01 to 0.15%; Si: 2.0% or less; Mn: 3.0% or less; Cr: 10.0 to 20.0%; Ni: 5.0 to 13.0%; N: 0.01 to 0.30%; Nb: 0 to 0.5%; Ti: 0 to 0.5%; and V: 0 to 0.5%, with the balance: Fe and impurities, wherein an average grain size is 10.0 μm or less, a difference in value of an average lattice constant $d_{Ave.}$ $(=\{d_{\gamma(111)}\times I_{\gamma(111)}+d_{\gamma(200)}\times I_{\gamma(200)}+d_{\gamma(220)}\times I_{\gamma(220)}+d_{\gamma(311)}\times I_{\gamma(311)}\}/\{I_{\gamma(111)}+I_{\gamma(200)}+I_{\gamma(220)}+I_{\gamma(311)}\})$ of an austenite phase between a surface portion and a center portion is 0.010 Å or more, and a value of a diffraction peak integrated intensity ratio r $(=100\times\Sigma I_{\gamma}/\Sigma I_{ALL})$ at a surface is 95% or more.

4 Claims, No Drawings

(56) References Cited

OTHER PUBLICATIONS

E. Camps et al., "Microwave plasma nitrided austenitic AISI-304 stainless steel", Surface and Coatings Technology, Aug. 4, 1998, vol. 106, No. 2/3, p. 121-128.
D. Manova et al., "Influence of grain size on nitrogen diffusivity in austenitic stainless steel", Surface and Coatings Technology, Apr. 23, 2007, vol. 201, No. 15, p. 6686-6689.
Jiang Xin-tao et al., Handbook of Practical Heat Treatment, 2nd edition, Shanghai Science and Technology Publishing House, Apr. 2014.
S.R. Kappaganthe et al., "Formation of an MN-type . . . stainless steel-nitrogen films", Journal of Crystal Growth, No. 267, Dec. 31, 2004, pp. 385-393.
Masami Sawada et al., "Effect of Precipitation Distribution on Grain Grow of Metastable Austenitic Stainless Steels", Current Advances in Materials and Processes, vol. 21, No. 2, Jan. 9, 2008, p. 1462.

* cited by examiner

AUSTENITIC STAINLESS STEEL

TECHNICAL FIELD

The present invention relates to an austenitic stainless steel.

BACKGROUND ART

In recent years, attention has been paid to use of hydrogen for greenhouse gas emission control, backed by environmental issue. To this end, metal products applied to structure members are needed; such structure members include those of fuel cells, which convert hydrogen into energy, as well as those of marine vessels, pipes, and trailers that transport hydrogen, storage tanks, and hydrogen stations for providing hydrogen to users.

At the beginning, hydrogen is used in the form of a high-pressure gas having a pressure of about 40 MPa, which however involves a major safety problem because hydrogen can penetrate a steel micro-structure to cause embrittlement of a metal product. Meanwhile, in terms of efficient use of hydrogen, there is a desire to use a hydrogen gas at further increased pressures. In addition, for example, reduction of size and weight is required of systems and fuel tanks of fuel cell powered vehicle, and thus even higher strengths are required of metal products. In other words, the current situation is that there is still an increased concern on embrittlement of metal products used in relation to hydrogen.

In conventional practice, for metal products used in relation to hydrogen, austenitic stainless steels such as SUS304 and SUS316 (JIS G 4315) have been employed. SUS304 belongs to a metastable austenitic stainless steel and generally has an excellent balance between strength and elongation after strain induced transformation into a hard, martensite phase. However, SUS304 has a problem in that once the martensite phase is generated, hydrogen easily penetrates the stainless steel, which makes embrittlement prominent (increases susceptibility). Meanwhile, SUS316 has a high austenite stability and has a low susceptibility to hydrogen embrittlement, but a problem with SUS316 is that a resultant strength remains at a low value. In addition, another problem with SUS316 is that Ni (nickel), which is classified as a rare metal element and expensive, needs to be contained in a large amount, as an austenite stabilizing element.

Hence, there have been proposed many austenitic stainless steels that are subject to use in a hydrogen environment. For example, Patent Documents 1 and 2 disclose materials that are obtained by improving the stainless steels described above. Patent Documents 3 and 4 disclose materials that contain Mn as an austenite stabilizing element in place of Ni, which is an expensive and rare metallic element. In addition, Patent Documents 5 and 6 disclose materials that have a modified surface film, typical of stainless steels, for inhibiting the penetration of hydrogen. Patent Documents 7 to 9 disclose materials that have an increased surface nitrogen concentration.

LIST OF PRIOR ART DOCUMENTS

Patent Document

Patent Document 1: JP2009-133001A
Patent Document 2: JP2014-114471A
Patent Document 3: JP2007-126688A
Patent Document 4: WO 2007/052773

Patent Document 5: JP2009-299174A
Patent Document 6: JP2014-109059A
Patent Document 7: JP2007-270350A
Patent Document 8: JP2006-70313A
Patent Document 9: JP2007-31777A However, none of the inventions disclosed in Patent Documents 1 to 6 increases a solubility of nitrogen in a rolled steel sheet by causing the rolled steel sheet to absorb nitrogen, in order to inhibit hydrogen embrittlement of the rolled steel sheet. Both methods disclosed in Patent Documents 7 and 8 include annealing an austenitic stainless steel in a nitrogen gas atmosphere so that a nitrogen concentration in an outer-layer region of the austenitic stainless steel is higher than a nitrogen concentration in a center region. The method disclosed in Patent Document 9 includes working after annealing, followed by nitriding. However, the production methods disclosed in Patent Documents 7 to 9 do not include a process of refining a steel micro-structure in advance to promote nitrogen absorption before annealing in a nitrogen gas atmosphere, and therefore involve a problem in that a degree of austenite stability of an outer-layer region of the produced steel sheet is not increased sufficiently.

SUMMARY OF INVENTION

Technical Problem

An objective of the present invention is to provide a SUS304-based metastable austenitic stainless steel that does not bring about embrittlement when used in a hydrogen environment, is excellent in balance between strength and elongation, and is inexpensive.

Solution to Problem

The present invention has been made to solve the problems described above, and the gist of the present invention is the following austenitic stainless steel.

(1) An austenitic stainless steel having a chemical composition comprising, by mass %:

C: 0.01 to 0.15%;
Si: 2.0% or less;
Mn: 3.0% or less;
Cr: 10.0 to 20.0%;
Ni: 5.0 to 13.0%;
N: 0.01 to 0.30%;
Nb: 0 to 0.5%;
Ti: 0 to 0.5%;
V: 0 to 0.5%, and
the balance: Fe and impurities, wherein
an average grain size is 10.0 μm or less,
a difference in value of an average lattice constant $d_{Ave.}$ of an austenite phase between a surface portion and a center portion is 0.010 Å or more, the average lattice constant $d_{Ave.}$ being defined by a following formula (i), and
a value of a diffraction peak integrated intensity ratio r at a surface is 95% or more, the diffraction peak integrated intensity ratio r being defined by a following formula (ii):

$$d_{Ave.}=\{d_{\gamma(111)}\times I_{\gamma(111)}+d_{\gamma(200)}\times I_{\gamma(200)}+d_{\gamma(220)}\times I_{\gamma(220)}+d_{\gamma(311)}\times I_{\gamma(311)}\}/\{I_{\gamma(111)}+I_{\gamma(200)}+I_{\gamma(220)}+I_{\gamma(311)}\} \quad \text{(i)}$$

where $d_{\gamma(hkl)}$: lattice constant (Å) that is calculated from a Bragg angle of an X-ray diffraction peak on an (hkl) plane of the austenite phase, $I_{\gamma(hkl)}$: integrated intensity (cps·deg) of the X-ray diffraction peak on the (hkl) plane of the austenite phase, $$r=100\times\Sigma I_{\gamma}/\Sigma I_{ALL} \quad \text{(ii)}$$

where $\Sigma I_{\gamma}$: sum of integrated intensities (cps·deg) at X-ray diffraction peaks of all austenite phases, $\Sigma I_{ALL}$: sum of integrated intensities (cps·deg) at all X-ray diffraction peaks.

(2) The austenitic stainless steel according to the above (1), wherein the difference in value of an average lattice constant $d_{Ave.}$ of an austenite phase between a surface portion and a center portion is 0.030 Å or more, the average lattice constant $d_{Ave.}$ being defined by the formula (i).

(3) The austenitic stainless steel according to the above (1) or (2), wherein the chemical composition further containing one or more elements selected from, by mass %:

Nb: 0.01 to 0.5%;

Ti: 0.01 to 0.5%; and

V: 0.01 to 0.5%.

Advantageous Effects of Invention

According to the present invention, it is possible to supply, an industrially stable SUS304-based metastable austenitic stainless steel that does not bring about embrittlement when used in a hydrogen environment, is excellent in balance between strength and elongation, and is inexpensive.

DESCRIPTION OF EMBODIMENTS

To solve the problems described above, the present inventors conducted studies about factors that influence the stability of an austenite phase of a metastable austenitic stainless steel.

As a result, it was confirmed that refining of grains and dissolution of nitrogen in an austenite phase stabilizes the austenite phase. In addition, the refining of grains promotes nitrogen absorption in heat treatment at relatively low temperature. Then, combination of the refining of grains and the promotion of nitrogen absorption exerts a remarkable effect.

Specifically, it was found that the refining of grains and the promotion of nitrogen absorption enables industrially stable supply of an austenitic stainless steel that does not bring about embrittlement when used in a hydrogen environment and is excellent in balance between strength and elongation.

In addition, it was clarified that the refining of grains is promoted by performing, on a rolled steel sheet, working involving transformation into a martensite phase before performing a grain refining process on the rolled steel sheet, which allows for obtaining an excellent property with stability.

The present invention has been made based on the findings described above. Requirements of the present invention will be described below in detail.

(A) Chemical Composition

The reasons for limiting the content of each element are as follows. In the following description, the symbol "%" for the content of each element means "percent by mass".

C: 0.01 to 0.15%

C (carbon) is a strong austenite-stabilizing element (hereafter, "austenite" may be abbreviated to "γ") as with N (nitrogen) described later, and is an interstitial solid-solution strengthening element that strengthens a γ phase microstructure by being dissolved in the γ phase micro-structure. However, an excessive content of C leads to precipitation of carbides in a large amount in heat treatment aiming at grain refining, resulting in a failure to obtain a required stability and strength of an austenite phase. Consequently, a content of C is set at 0.01 to 0.15%. The content of C is preferably 0.02% or more and is preferably 0.13% or less.

Si: 2.0% or less

Si (silicon) is an element that functions as a deoxidizer in melting, and is also a ferrite stabilizing element. However, an excessive content of Si causes coarse inclusions to be generated, resulting in a decrease in workability, as well as an unstable austenite phase. Consequently, a content of Si is set at 2.0% or less. The content of Si is preferably 0.9% or less. Although no lower limit is set for the content of Si, the content of Si is preferably 0.05% or more to obtain the deoxidation effect described above.

Mn: 3.0% or less

Mn (manganese) is a γ phase stabilizing alloying element that is useful and relatively inexpensive. However, an excessive content causes coarse inclusions to be generated, resulting in a decrease in workability. Consequently, a content of Mn is set at 3.0% or less. The content of Mn is preferably 2.6% or less. Although no lower limit is set for the content of Mn, the content of Mn is preferably 0.1% or more to obtain the effect described above.

Cr: 10.0 to 20.0%

Cr (chromium) is a basic element of stainless steel and is an element that is effective in obtaining corrosion resistance. However, Cr is a ferrite stabilizing element, and an excessive content of Cr makes a γ phase unstable and increases a risk of forming compounds with C and N. Consequently, a content of Cr is set at 10.0 to 20.0%. The content of Cr is preferably 10.5% or more and is preferably 19.4% or less.

Ni: 5.0 to 13.0%

Ni (nickel) is one of the strongest γ phase stabilizing elements and is, as with C and N, an element necessary to allow a γ phase to exist in a stable state down to a room temperature. However, as described above, Ni is an expensive and rare alloying element and is desirably reduced as much as possible, and therefore, an upper limit of a content of Ni is set to be equivalent to that of an SUS304-based metastable austenitic stainless steel. Consequently, the content of Ni is set at 5.0 to 13.0%. The content of Ni is preferably 5.4% or more, more preferably 6.0% or more. The content of Ni is preferably 10.0% or less, more preferably 9.0% or less.

N: 0.01 to 0.30%

N (nitrogen) is one of the strongest γ phase stabilizing elements and is an interstitial, useful solid-solution strengthening element. However, an excessive content leads to precipitation of nitrides, resulting in a failure to obtain a required strength and a required stability of the γ phase. Consequently, a content of N is set at 0.01 to 0.30%. The content of N is preferably 0.02% or more and is preferably 0.28% or less. Note that the steel according to the present invention has a distribution of a N amount in which the N amount is high at a surface of the stainless steel and decreases at a center portion of the stainless steel, and the content of N means herein an average value over the whole thickness of the steel.

Nb: 0 to 0.5%

Ti: 0 to 0.5%

V: 0 to 0.5%

Nb (niobium), Ti (titanium), and V (vanadium) each combine with C and N to form compounds that inhibit growth of grains by the pinning effect. Therefore, to obtain this effect, one or more elements selected from Nb, Ti, and V may be contained as necessary. However, when a content of any one of the elements becomes more than 0.5%, a coarse compound is generated, which increases a risk of destabilizing formation of a γ phase and degrades workability, and the coarse compound serves as a starting point of a breakage. Therefore, a content of each of these elements is set as Nb: 0.5% or less, Ti: 0.5% or less, V: 0.5% or less. The content of each element is preferably Nb: 0.4% or less, Ti: 0.4% or less, V: 0.4% or less. To obtain the effect described above, one or more elements selected from Nb: 0.01% or more, Ti: 0.01% or more, V: 0.01% or more are preferably contained.

(B) Steel Micro-Structure

In the steel according to the present invention, an average grain size is set at 10.0 μm or less. The reason is that grain refining contributes to improvement of thermal stability of a γ phase in the steel and improvement of a balance between strength and elongation. The average grain size is preferably 5.0 μm or less, more preferably 3.0 μm or less.

In the steel according to the present invention, in the X-ray diffraction, a difference in value of an average lattice constant $d_{Ave.}$ of an austenite phase between a surface portion and a center portion is 0.010 Å or more, the average lattice constant $d_{Ave.}$ being defined by the following formula (i):

$$d_{Ave.}=\{d_{\gamma(111)}\times I_{\gamma(111)}+d_{\gamma(200)}\times I_{\gamma(200)}+d_{\gamma(220)}\times I_{\gamma(220)}+d_{\gamma(311)}\times I_{\gamma(311)}\}/\{I_{\gamma(111)}+I_{\gamma(200)}+I_{\gamma(220)}+I_{\gamma(311)}\} \quad \text{(i)}$$

where $d_{\gamma(hkl)}$: lattice constant (Å) that is calculated from a Bragg angle of an X-ray diffraction peak on an (hkl) plane of the austenite phase, $I_{\gamma(hkl)}$: integrated intensity (cps·deg) of the X-ray diffraction peak on the (hkl) plane of the austenite phase.

Note that the surface portion refers to a zone from an outermost surface of steel, the zone having a depth to the extent including at least one grain, and for example, the surface portion can be regarded as a steel micro-structure existing from an outermost surface of steel down to 10 μm deep. In addition, the center portion refers to a portion having a thickness to the extent including at least one grain that lies across a sheet-thickness-center plane, which is assumed as a plane of symmetry, and the center portion is regarded as a steel micro-structure existing within ranges of 10 μm symmetrically on both sides of the sheet-thickness-center plane, which is assumed as a plane of symmetry.

As described above, in the grain refining, the dissolution of nitrogen in an austenite phase is very effective for inhibiting hydrogen embrittlement and contributes to improvement of the strength. To obtain such an effect, a difference in the average lattice constant between a surface and a center portion is limited. The difference in the value of the average lattice constant $d_{Ave.}$ of an austenite phase between a surface portion and a center portion is preferably 0.015 Å or more, more preferably 0.020 Å or more, still more preferably 0.030 Å or more. Setting the difference in the average lattice constant at 0.030 Å or more provides a particularly remarkable effect, which substantially inhibits the hydrogen embrittlement.

The lattice constant of an austenite phase is increased by the dissolution of the interstitial elements such as C and N described above. Therefore, in the present invention, a limitation is intended on a difference in value of the lattice constant between a surface portion of stainless steel where the value is maximized by nitrogen absorption from a surface and the center portion at which the value is least influenced. A change in the lattice constant d brought by a solubility of nitrogen N can be calculated from an empirical rule as follows.

$$d=3.5946+0.0348\times N$$

When the difference in the average lattice constant is 0.010 Å, the nitrogen solubility at the surface is higher than that at the center portion by about 0.29%. In a case of measurement of stainless steel using a Kα line of a typical Cu target, a penetration depth of an X-ray is about 10 μm, although it depends on a power of the X-ray. In other words, this limitation indicates that the amount of N in grains with which the surface of stainless steel is covered is higher than the amount of N of the center portion by about 0.29%.

When the difference in the average lattice constant is 0.030 Å or more, the nitrogen solubility at the surface is higher than that at the center portion by about 0.87% or more. In other words, when 0.13% of nitrogen is dissolved in a starting material, a nitrogen solubility at a surface is 1.0% or more.

The lattice constant of a γ phase is calculated from diffraction peaks and determined as an average value in accordance with integrated intensity ratios of major (111), (200), (220) peaks.

In the steel according to the present invention, in X-ray diffraction, a value of diffraction peak integrated intensity ratio r at a surface is 95% or more, the diffraction peak integrated intensity ratio r being defined by the following formula (ii):

$$r=100\times\Sigma I_{\gamma}/\Sigma I_{ALL} \quad \text{(ii)}$$

where $\Sigma I_{\gamma}$: sum of integrated intensities (cps·deg) at X-ray diffraction peaks of all austenite phases, $\Sigma I_{ALL}$: sum of integrated intensities (cps·deg) at all X-ray diffraction peaks.

For the inhibition of hydrogen embrittlement, it is very effective that a stainless steel surface is covered with austenite phases. To obtain the effect, the diffraction peak integrated intensity ratio r is defined as above. The value of diffraction peak integrated intensity ratio r at a surface is preferably 98% or more, more preferably 100% (indicating an austenite single phase).

For the inhibition of hydrogen embrittlement, it suffices that the surface being covered with austenite phases, and a martensite may exist inside the steel. The existence of a martensite inside the steel allows improvement of a strength of the steel. In other words, there is no particular limit on the value of r for regions other than the surface.

(C) Production Method

As to a method for producing an austenitic stainless steel according to the present invention, no special limit is provided, but use of the following production method enables the production of the austenitic stainless steel. The following production method involves, for example, a working process, a heat treatment process, and a nitrogen absorption treatment process, in this order. These processes will be described in detail.

<Working Process>

First, a steel such as a rolled steel sheet is subjected to working involving transformation into martensite phase. By performing the working, martensitie transformation is promoted, a steel micro-structure of fine and regulated-sized grains is produced after heat treatment to be described later, whereby a steel excellent in balance between strength and elongation is obtained. In this working process, it is necessary to subject the steel micro-structure of the rolled steel sheet to martensitic transformation sufficiently before the heat treatment process. Ideally, 100% of the steel micro-structure of the rolled steel sheet is desirably made into a martensite phase, but it suffices that the steel micro-structure includes martensite phases at 95% or more in terms of volume ratio.

This working process is preferably performed in a temperature condition of a room temperature or lower, for example, a temperature condition of 30° C. or lower. A temperature in the working is preferably set at −30° C. or lower, more preferably −50° C. or lower, although it depends on a composition of the stainless steel.

The working described above includes, for example, cold rolling on the rolled steel sheet. In addition, extruding, drawing, or the like of a rolled steel sheet or a cast piece in a cold condition may be employed. To transform 95% or greater of a steel micro-structure of a rolled steel sheet into martensite phases, the working process described above may be repeated. For example, a cold-rolled steel sheet about 50% of which undergoes martensitic transformation may be further subjected to cold working, so as to be sufficiently transformed, and cold working is further performed on a steel sheet in which 95% or greater of a steel micro-structure is martensite phases.

<Heat Treatment Process>

After the martensitic transformation by the working process, a heat treatment process for reverse transformation to an austenite parent phase is performed. By this heat treatment process, grains in an austenite phase are remarkably refined, which improves a stability of the austenite phase, so as to strengthen the steel micro-structure of the steel. To obtain a steel excellent in balance between strength and elongation, however, growth of grains in the heat treatment process, and grain size regulation accompanying the growth are necessary. In the growth of grains and the grain size regulation, grain sizes are preferably set at 0.5 μam or more, more preferably set at 1.0 μm or more. To achieve such grain sizes, a heat treatment temperature is preferably set at 700 to 1000° C. or lower, more preferably set at 750 to 950° C., although it depends on a composition of the stainless steel.

<Nitrogen Absorption Treatment Process>

After the heat treatment process, heat treatment for nitrogen absorption is performed with the fine grain microstructure of the austenite phase maintained. To maintain the austenite phase, a heating temperature in a nitrogen absorption treatment process is set within a temperature range not higher than the heating temperature in the reverse transformation and the heat treatment process accompanied with the grain growth, which is preferable because such a setting allows for inhibition of grain growth in the nitrogen absorption treatment process. Specifically, to inhibit the grain growth sufficiently and maintain the fine grain micro-structure, the heating temperature in the nitrogen absorption treatment process is preferably set at 300 to 700° C., more preferably 350 to 650° C. Performing the nitrogen absorption treatment process at a temperature higher than 700° C. increases the risk of the grain growth and is not preferable.

In addition, the nitrogen absorption treatment process is performed by heating the stainless steel in a mixed atmosphere including a gas such as hydrogen sulfide and hydrogen fluoride for removing an oxide film of the stainless steel, and a gas such as nitrogen and ammonia serving as a nitrogen source. This nitrogen absorption treatment process is performed by supplying nitrogen after removing surface oxide film that inhibits the absorption. It is thereby possible to set the difference in the average lattice constant $d_{Ave.}$ of the austenite phase between the surface and the center portion at 0.010 Å or more, so as to inhibit the hydrogen embrittlement.

Hereunder, the present invention is more specifically described with reference to Examples, but the present invention is not limited to these Examples.

EXAMPLE

Compositions of test steels are shown in Table 1. The test steels were a small ingot at a laboratory level having an adjusted chemical composition. Using equipment at a laboratory level, the test steels were subjected to hot rolling into a sheet thickness of 4 mm at 1100° C., then annealing of 1100° C.×30 min, and cold rolling into a sheet thickness of 1 mm. Some of the test materials shown in Table 2 were subjected to a process of the cold rolling into the sheet thickness of 1 mm after retention in a liquid nitrogen for five minutes, for promotion of strain induced martensitic transformation. The cold rolling was performed a plurality of times, and each time performed after the retention in the liquid nitrogen for five minutes.

TABLE 1

| | Chemical composition (by mass %, balance: Fe and impurities) | | | | | | | | |
|---|---|---|---|---|---|---|---|---|---|
| Steel | C | Si | Mn | Cr | Ni | N | Nb | V | Ti |
| A | 0.06 | 0.52 | 0.48 | 17.16 | 6.84 | 0.05 | — | — | — |
| B | 0.02 | 0.69 | 0.67 | 17.04 | 6.75 | 0.14 | — | — | — |
| C | 0.12 | 1.46 | 2.63 | 12.68 | 8.62 | 0.18 | — | — | — |
| D | 0.03 | 0.52 | 0.56 | 18.64 | 8.55 | 0.24 | — | — | — |
| E | 0.02 | 0.48 | 0.72 | 18.02 | 8.23 | 0.12 | — | — | — |
| F | 0.03 | 0.59 | 0.36 | 15.96 | 5.52 | 0.12 | 0.24 | — | — |
| G | 0.04 | 0.87 | 1.03 | 18.21 | 8.05 | 0.13 | 0.11 | 0.23 | — |
| H | 0.05 | 0.63 | 1.04 | 17.66 | 8.02 | 0.13 | — | — | 0.08 |
| I | <0.01 * | 0.52 | 2.62 | 19.02 | 5.13 | <0.01 * | — | — | — |
| J | 0.19 * | 0.63 | 1.92 | 15.68 | 5.43 | <0.01 * | — | — | — |
| K | 0.31 * | 2.48 * | 0.63 | 18.13 | 8.01 | 0.12 | — | — | — |
| L | 0.04 | 0.49 | 0.36 | 25.83 * | 5.66 | 0.45 * | — | — | — |
| M | 0.03 | 0.63 | 3.43 * | 18.09 | 3.96 * | 0.09 | 0.89 * | — | — |
| N | 0.10 | 0.54 | 1.42 | 16.46 | 6.63 | 0.34 * | — | 0.66 * | 0.69 * |

* indicates that conditions do not satisfy those defined by the present invention.

TABLE 2

| Test No. | Steel | Production condition: Rolling temperature (° C.) | Heating temperature (° C.) | Nitrogen absorption treatment temperature (° C.) | Nitrogen absorption treatment atmosphere | Average grain size (μm) | Difference of $d_{Ave.}$ between surface portion and center portion (Å) | r values at surface portion (%) | Room temperature tensile property: Tensile strength (MPa) | Elongation (%) | Hydrogen embrittlement | |
|---|---|---|---|---|---|---|---|---|---|---|---|---|
| 1 | A | Room temperature | 900 | 450 | $NH_3 + H_2S$ | 3.0 | 0.183 | 99 | 1354 | 13.6 | ○○ | Inventive example |
| 2 | | Liquid nitrogen | 900 | 450 | $NH_3 + H_2S$ | 1.2 | 0.288 | 100 | 1423 | 13.8 | ○○ | |
| 3 | B | Room temperature | 800 | 400 | $NH_3 + H_2S$ | 1.2 | 0.051 | 100 | 1482 | 12.9 | ○○ | |
| 4 | | Room temperature | 900 | 400 | $NH_3 + H_2S$ | 1.4 | 0.042 | 99 | 1446 | 13.1 | ○○ | |
| 5 | | Room temperature | 1000 | 400 | $NH_3 + H_2S$ | 7.4 | 0.043 | 99 | 1397 | 15.1 | ○○ | |
| 6 | C | Room temperature | 900 | 400 | $NH_3 + H_2S$ | 2.6 | 0.068 | 100 | 1431 | 14.2 | ○○ | |
| 7 | D | Room temperature | 900 | 450 | $NH_3 + H_2S$ | 3.1 | 0.168 | 99 | 1536 | 12.1 | ○○ | |
| 8 | E | Room temperature | 800 | 450 | $NH_3 + H_2S$ | 2.1 | 0.189 | 100 | 1283 | 14.7 | ○○ | |
| 9 | | Room temperature | 900 | 450 | $NH_3 + H_2S$ | 2.8 | 0.185 | 100 | 1247 | 15.6 | ○○ | |
| 10 | | Room temperature | 1000 | 450 | $NH_3 + H_2S$ | 8.3 | 0.176 | 99 | 1219 | 16.8 | ○○ | |
| 11 | | Liquid nitrogen | 900 | 450 | $NH_3 + H_2S$ | 1.1 | 0.217 | 100 | 1289 | 16.1 | ○○ | |
| 12 | F | Room temperature | 900 | 450 | $NH_3 + H_2S$ | 1.5 | 0.282 | 100 | 1273 | 12.6 | ○○ | |
| 13 | G | Room temperature | 900 | 450 | $NH_3 + H_2S$ | 1.5 | 0.198 | 99 | 1313 | 13.6 | ○○ | |
| 14 | H | Room temperature | 900 | 450 | $NH_3 + H_2S$ | 1.4 | 0.223 | 100 | 1279 | 12.8 | ○○ | |
| 15 | A | Room temperature | 900 | 800 | $N_2$ | 1.6 | 0.002 * | 83 * | 1468 | 11.4 | X | Comparative example |
| 16 | B | Room temperature | 900 | 1100 | $N_2$ | 21.5 * | 0.014 | 73 * | 1366 | 6.7 | X | |
| 17 | | Room temperature | 1100 | 400 | $NH_3 + H_2S$ | 21.3 * | 0.041 | 88 * | 1362 | 7.2 | X | |
| 18 | E | Room temperature | 900 | 800 | $N_2$ | 1.9 | 0.003 * | 81 * | 1431 | 11.8 | X | |
| 19 | I | Room temperature | 900 | 900 | $H_2 + H_2S + N_2$ | 5.6 | 0.008 * | 68 * | 981 | 9.3 | X | |
| 20 | J | Room temperature | 900 | 900 | $H_2 + H_2S + N_2$ | 15.6 * | 0.007 * | 62 * | 1261 | 7.3 | X | |
| 21 | | Room temperature | 900 | 450 | $NH_3 + H_2S$ | 15.4 * | 0.161 | 83 * | 1244 | 5.8 | X | |
| 22 | K | Room temperature | 900 | 900 | $H_2 + H_2S + N_2$ | 14.6 * | 0.012 | 71 * | 1522 | 4.3 | X | |
| 23 | | Room temperature | 900 | 450 | $NH_3 + H_2S$ | 16.1 * | 0.146 | 79 * | 1531 | 3.8 | X | |
| 24 | L | Room temperature | 900 | 900 | $H_2 + H_2S + N_2$ | 14.3 * | 0.004 * | 71 * | 1567 | 5.4 | X | |
| 25 | M | Room temperature | 900 | 900 | $H_2 + H_2S + N_2$ | 12.6 * | 0.003 * | 74 * | 1422 | 9.6 | X | |
| 26 | N | Room temperature | 900 | 900 | $H_2 + H_2S + N_2$ | 15.8 * | 0.003 * | 66 * | 1623 | 4.6 | X | |
| 27 | B | Room temperature | — | 1200 | $H_2 + H_2S + N_2$ | 52.3 * | 0.023 | 86 * | 1214 | 9.6 | X | |
| 28 | | Room temperature | — | 500 | $NH_3 + H_2S$ | — ** | 0.103 | 71 * | 1536 | 3.2 | X | |

* indicates that conditions do not satisfy those defined by the present invention.

** indicates that conditions do not satisfy those defined by the present invention, and structure by rolling before heat treatment remains.

After the cold rolling process, for the reverse transformation from the martensite phase to the austenite parent phase, heat treatment of retaining the test steels at temperatures shown in Table 2 for three minutes was performed, and subsequently nitrogen absorption treatment was performed in conditions (nitrogen absorption treatment temperatures and atmospheres) shown in Table 2. Finally, thermal refining rolling into a sheet thickness of 0.5 mm was performed at room temperature, for performance adjustment.

In the nitrogen absorption treatment process, when the heating was performed at 700° C. or lower, a gaseous mixture of 75% ammonia ($NH_3$)+25% hydrogen sulfide was used as an atmosphere in the heating, and 100% ammonia was used as an atmosphere used from the retention at the nitrogen absorption treatment temperature to the cooling. In these examples, the retention was performed at the nitrogen absorption treatment temperature for four hours. The nitrogen absorption treatment atmospheres of these examples are shown as "$NH_3$+$H_2S$" in Table 2. A temperature rise time period taken for a temperature to rise to the nitrogen absorption treatment temperature was about 30 minutes.

Meanwhile, when the nitrogen absorption treatment temperature was more than 700° C. in the nitrogen absorption treatment process, the retention was performed at the temperature for 10 minutes. In examples in which the nitrogen absorption treatment process was performed at a temperature more than 700° C., and the nitrogen absorption treatment atmospheres are shown as "$H_2$+$N_2$+$H_2S$" in Table 2, a gaseous mixture of "49% hydrogen ($H_2$)+50% nitrogen ($N_2$)+1% hydrogen sulfide ($H_2S$)" was used as an atmosphere used during a period until a temperature rose to 500° C., and a gaseous mixture of "50% hydrogen+50% nitrogen" was used as an atmosphere used during a period in which a temperature exceeded 500° C. to reach the nitrogen absorption treatment temperature, the retention was performed, and the cooling to the room temperature was performed. In the heating, a time period taken for a temperature to rise to 500° C. was about one minute.

In examples in which the nitrogen absorption treatment process was performed at a temperature more than 700° C., and the nitrogen absorption treatment atmospheres are shown as "$N_2$" in Table 2, a 100% nitrogen gas was used throughout the nitrogen absorption treatment process from the temperature rise to the cooling.

Specimens were taken from the test materials, and grain sizes before the thermal refining rolling, average lattice constants ($d_{Ave.}$) at surface portions and center portions, ratios of austenite phase (r values) at the surface after the thermal refining rolling, and tensile properties were measured. To measure a grain size, a cross section parallel to a rolling direction of a specimen was formed, the cross section was ground, the cross section was etched using a predetermined acid mixture solution, and a steel micro-structure of the cross section was investigated under an optical microscope or an SEM. Then, the grain size was measured in an average and representative region.

The average lattice constants ($d_{Ave.}$) at surface portions and center portions, the ratios of austenite phase (r values) at surface portions were measured using an X-ray diffractometer and calculated by the formula (i) and the formula (ii)

described above. As the surface portion, a steel microstructures existing within a zone of 10 μm from an outermost surface of a specimen was taken. As the center portion, a steel micro-structure existing within zones of 10 μm that lie across a sheet-thickness-center plane was taken.

As to the tensile properties, specimens were taken in a direction parallel to the rolling direction, and tensile strengths and elongations were measured using an instron tensile test machine. The measurement was conducted at room temperature. Hydrogen embrittlement was determined in terms of a change in elongation in measurement of tensile properties after retention of 250° C.×100 h in a hydrogen gas at 45 MPa. In the determination, a case where a value of the elongation after retention was less than 85% of a value before the retention in the hydrogen gas ("ELONGATION (%)" in "ROOM TEMPERATURE TENSILE PROPERTY" in Table 2) was determined to be x, a case where the value of the elongation after retention was 85% or greater and less than 95% of the value before the retention in the hydrogen gas was determined to be ○, and a case where the value of the elongation after retention was 95% or greater of the value before the retention in the hydrogen gas was determined to be ○○.

These results are shown in Table 2 altogether.

Test Nos. 1 to 14, which satisfied all of the definition of the present invention, had grain sizes of 10.0 μm or less, and all achieved tensile strengths of 1200 MPa or more and elongations of 12% or more, exerting an excellent balance between strength and elongation. In addition, by setting the difference in $d_{Ave.}$ between surface portion and center portion at 0.010 Å or more as grains were refined, the r values at surface were 95% or more, and hydrogen embrittlement was inhibited sufficiently.

In particular, when the difference in $d_{Ave.}$ between surface and center was 0.030 Å or more, evaluation of the hydrogen embrittlement was ○○, showing a remarkable inhibition effect. In particular, in Test Nos. 2 and 11, in which the working involving transformation into martensite phase was performed at a low temperature of a room temperature or lower, specifically, at the liquid nitrogen temperature, grains were further refined, and Test Nos. 2 and 11 showed the best performance out of the same kind of test steels.

Meanwhile, in Test Nos. 15 to 18, while the compositions of the steels satisfied the definition of the present invention, production conditions were inappropriate, so that all of the requirements defined in the present invention were not satisfied, thus resulting in occurrence of the hydrogen embrittlement.

Specifically, in Test Nos. 15 and 18, while relatively excellent balances between strength and elongation were shown, but atmospheres used in the nitrogen absorption treatment were inappropriate, and differences in $d_{Ave.}$ between surface portion and center portion were small, so that the r values at surface fell out of the defined range after the thermal refining rolling, resulting in occurrence of the hydrogen embrittlement. In Test Nos. 16 and 17, heating temperatures in the heat treatment or the nitrogen absorption treatment were high, and grain sizes were large, so that the r values at surface fell out of the defined range after the thermal refining rolling, thus resulting in occurrence of the hydrogen embrittlement.

In Test Nos. 19 to 28, the compositions of the steels did not satisfy the definition of the present invention, one or both of the grain size and the difference in $d_{Ave.}$ between surface portion and center portion did not satisfy the definition of the present invention even in a ease where the steel was produced in appropriate conditions, and the r values at surface fell out of the definition of the present invention, thus resulting in occurrence of the hydrogen embrittlement. In addition, the elongations remained 10% or less, also failing to achieve excellent balances between strength and elongation.

Test Nos. 27 and 28 were examples in which heat treatment serving both the reverse transformation from martensite to austenite and the nitrogen absorption was performed. In Test No. 27, a temperature in the heat treatment was high, and the grain size were significantly large, and the r value at surface fell out of the defined range after the thermal refining rolling, thus resulting in occurrence of the hydrogen embrittlement. In Test No. 28, the temperature in the heat treatment was low, and thus a strain induced martensite phase remained formed in the cold rolling, the previous process, which made the reverse transformation into austenite parent phase insufficient, so that the r values at surface fell out of the defined range after the thermal refining rolling, thus resulting in occurrence of the hydrogen embrittlement.

INDUSTRIAL APPLICABILITY

As seen from the above, according to the present invention, it is possible to supply, industrially and stably, an SUS304-based metastable austenitic stainless steel that does not bring about embrittlement when used in a hydrogen environment, is excellent in balance between strength and elongation, and is inexpensive.

The invention claimed is:

1. An austenitic stainless steel having a chemical composition comprising, by mass %:

C: 0.01 to 0.15%;
Si: 2.0% or less;
Mn: 3.0% or less;
Cr: 10.0 to 20.0%;
Ni: 5.0 to 13.0%;
N: 0.01 to 0.30%;
Nb: 0 to 0.5%;
Ti: 0 to 0.5%;
V: 0 to 0.5%, and
the balance: Fe and impurities, wherein
a tensile strength is 1200 MPa or more,
an average grain size is 10.0 μm or less,
a difference in value of an average lattice constant $d_{Ave.}$ of an austenite phase between a surface portion and a center portion is 0.010 Å or more, the average lattice constant $d_{Ave.}$ being defined by a following formula (i), where the surface portion is a zone of 10 μm from an outermost surface of the steel,
a martensite exists in the center portion, and
a value of a diffraction peak integrated intensity ratio r at a surface is 95% or more, the diffraction peak integrated intensity ratio r being defined by a following formula (ii):

$$d_{Ave.}=\{d_{\gamma(111)}\times I_{\gamma(111)}+d_{\gamma(200)}\times I_{\gamma(200)}+d_{\gamma(220)}\times I_{\gamma(220)}+d_{\gamma(311)}\times I_{\gamma(311)}\}/\{I_{\gamma(111)}+I_{\gamma(200)}+I_{\gamma(220)}+I_{\gamma(311)}\} \quad \text{(i)}$$

where $d_{\gamma(hkl)}$: lattice constant (Å) that is calculated from a Bragg angle of an X-ray diffraction peak on an (hkl) plane of the austenite phase, $I_{\gamma(hkl)}$: integrated intensity (cps·deg) of the X-ray diffraction peak on the (hkl) plane of the austenite phase, $$r=100\times\Sigma I_{\gamma}/\Sigma I_{ALL} \quad \text{(ii)}$$

where $\Sigma I_{\gamma}$: sum of integrated intensities (cps·deg) at X-ray diffraction peaks of all austenite phases, $\Sigma I_{ALL}$: sum of integrated intensities (cps·deg) at all X-ray diffraction peaks.

2. The austenitic stainless steel according to claim 1, wherein the difference in value of an average lattice constant $d_{Ave.}$ of an austenite phase between a surface portion and a center portion is 0.030 Å or more, the average lattice constant $d_{Ave.}$ being defined by the formula (i).

3. The austenitic stainless steel according to claim 2, wherein the chemical composition further containing one or more elements selected from, by mass %:

Nb: 0.01 to 0.5%;

Ti: 0.01 to 0.5%; and

V: 0.01 to 0.5%.

4. The austenitic stainless steel according to claim 1, wherein the chemical composition further containing one or more elements selected from, by mass %:

Nb: 0.01 to 0.5%;

Ti: 0.01 to 0.5%; and

V: 0.01 to 0.5%.

* * * * *